US005597157A

United States Patent [19]

Hamilton et al.

[11] Patent Number: 5,597,157

[45] Date of Patent: Jan. 28, 1997

[54] DOCUMENT HANDLING DEVICE FOR OVERTURNING A DOCUMENT

[75] Inventors: Alistair R. Hamilton, Dayton, Ohio; Robert W. Phillips, Waterloo, Canada

[73] Assignee: AT&T Global Information Solutions Company, Dayton, Ohio

[21] Appl. No.: 551,308

[22] Filed: Nov. 1, 1995

[51] Int. Cl.[6] ..... B65H 5/00; B65H 29/66

[52] U.S. Cl. ..... 271/225; 271/65; 271/186; 271/265.02

[58] Field of Search ..... 271/185, 186, 271/176, 225, 265.01, 265.02, 65, 188, 902

[56] References Cited

U.S. PATENT DOCUMENTS

| | | | |
|---|---|---|---|
| 3,987,465 | 10/1976 | Sippel | 271/65 X |
| 4,040,616 | 8/1977 | Clarkson et al. | 271/186 X |
| 4,089,515 | 5/1978 | Stange et al. | 271/902 X |
| 4,456,237 | 6/1984 | Buddendeck . | |
| 4,526,361 | 7/1985 | DuBois . | |
| 4,984,779 | 1/1991 | Iwasaki . | |
| 5,074,537 | 12/1991 | van Rijn . | |
| 5,181,714 | 1/1993 | Yamagishi et al. | 271/186 |
| 5,183,240 | 2/1993 | Morooka et al. | 271/265.01 |
| 5,203,554 | 4/1993 | Suzuki et al. | 271/186 X |
| 5,415,391 | 5/1995 | Wong et al. | 271/186 X |

*Primary Examiner*—Boris Milef
*Attorney, Agent, or Firm*—Michael Chan

[57] ABSTRACT

A document handling device overturns a document having a first side, a second side lying opposite the first side, a leading edge, a trailing edge, and a relatively long lengthwise dimension between the leading and trailing edges. The device comprises a housing unit including a reference surface defining at least in part an opening through which the document is fed into a document path defined within the housing unit. A transport unit receives the document which has been fed through the opening with the first side of the document facing the reference surface of the housing unit. The transport unit overturns the received document and feeds the overturned document back through the opening with the second side of the document facing the reference surface of the housing unit. The units define an accumulating space into which the document can bulge while the document is being overturned.

4 Claims, 11 Drawing Sheets

DOCUMENT HANDLING DEVICE FOR OVERTURNING A DOCUMENT

BACKGROUND OF THE INVENTION

The present invention relates to a document handling device, and is particularly directed to a document handling device for overturning a double-sided document.

Document handling devices for overturning a double-sided document are known. For example, such devices are used in copier machines which are capable of providing a double-sided copy of a double-sided document. Typically, a double-sided document to be copied is initially fed to an imaging device which captures an image of one side of the document. The double-sided document is then fed to a document handling device which overturns the document and feeds the overturned document back to the imaging device to capture an image of the other side of the document. Known copier machines which are capable of providing a double-sided copy of a double-sided document have a limitation in that the size of the document to be copied must be within predefined dimensions.

SUMMARY OF THE INVENTION

In accordance with one aspect of the present invention, a document handling device is provided for overturning a document having a first side, a second side lying opposite the first side, a leading edge, a trailing edge, and a lengthwise dimension extending between the leading and trailing edges. The device comprises a housing unit including a reference surface defining at least in part an opening through which the document is fed into a document path defined with the housing unit. A sensor unit is provided for (i) detecting the presence of the leading and trailing edges of the document as the document moves along the document path and (ii) providing signals indicative of the sensor unit detecting the presence of the leading and trailing edges of the document. A transport unit responsive to the signals of the sensor unit is provided for (i) receiving the document which has been fed through the opening with the first side of the document facing the reference surface of the housing unit, (ii) overturning the received document along the document path and (iii) feeding the overturned document back through the opening independent of the lengthwise dimension of the document and with the second side of the document facing the reference surface of the housing unit.

Preferably, the transport unit includes a mechanism which (i) engages the document to feed the document along the document path after the sensor unit has detected the presence of the leading edge of the document and (ii) engages a leading portion of the document to inhibit the leading portion of the document from further movement along the document path until the sensor unit detects the presence of the trailing edge of the document. A control unit responsive to the signals of the sensor unit is provided for controlling operation of the mechanism. The housing unit includes surface means defining an accumulating space into which the document can bulge while the mechanism engages the leading portion of the document to inhibit of the leading portion of the document from further movement along the document path and the mechanism continues to feed the trailing portion of the document along the document path.

In accordance with another aspect of the present invention, a document handling device is provided for overturning a document having a first side, a second side lying opposite the first side, a leading edge, a trailing edge, and a relatively long lengthwise dimension between the leading and trailing edges. The device comprises a housing unit including a reference surface defining at least in part an opening through which the document is fed into a document path defined within the housing unit. A transport unit is provided for (i) receiving the document which has been fed through the opening with the first side of the document facing the reference surface of the housing unit, (ii) overturning the received document and (iii) feeding the overturned document back through the opening with the second side of the document facing the reference surface of the housing unit. The units define an accumulating space into which the document can bulge while the document is being overturned.

In accordance with still another aspect of the present invention, an apparatus comprises at least one document processing device for processing a document having a first side, a second side lying opposite the first side, a leading edge, a trailing edge, and a lengthwise dimension extending between the leading and trailing edges. A document handling device includes a housing unit and a transport unit disposed in the housing unit for (i) receiving the processed document from the processing device after the processing device has processed the first side of the document, (ii) overturning the received document and (iii) feeding the overturned document back to the processing device independent of the lengthwise dimension of the document and with the second side of the document positioned relative to the processing device for processing by the processing device.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DETAILS OF THE INVENTION

Figure 1:
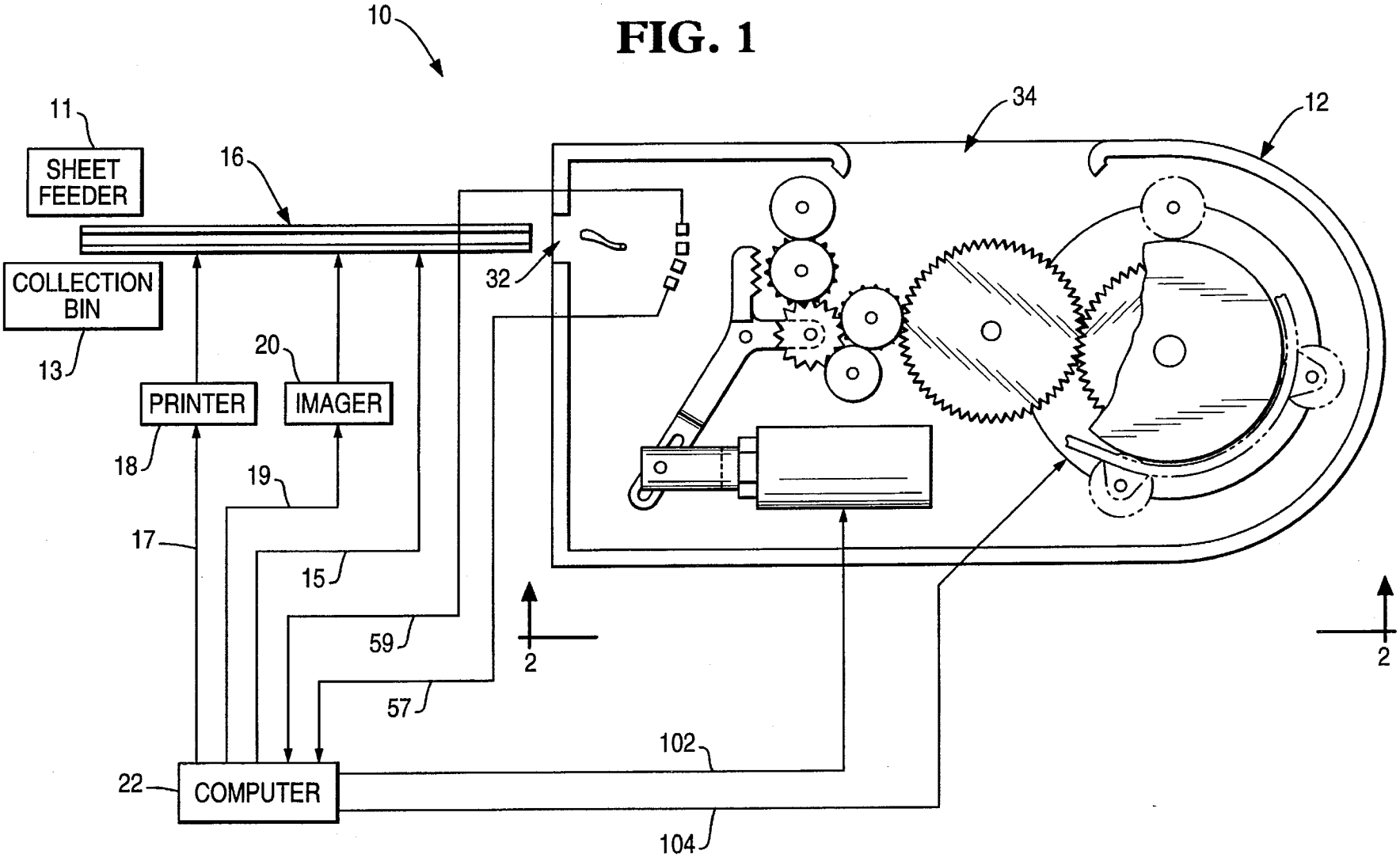
FIG. 1 is a schematic view of an apparatus embodying a document handling device constructed in accordance with the present invention.

Referring to FIG. 1, a document processing system 10 embodying a document handling device 12 constructed in accordance with the present invention is illustrated. The system 10 includes a bi-directional document track 16 which has a document path leading to the device 12. A sheet feeder 11 and a utilization device such as a collection bin 13 are located at one end of the document track 16.

The system 10 further includes a printer 18 adjacent the track 16, and an imager 20 also adjacent the track 16. The printer 18 prints information onto a document which moves along the track 16. The imager 20 extracts data relating to a document which moves along the track 16. Although only the printer 18 and the imager 20 are illustrated in FIG. 1 adjacent the track 16, there may be other devices adjacent the track 16.

A computer 22 monitors a number of output signals on lines 57, 59 from the device 12. The computer 22 generates a number of control signals on lines 102, 104 to control operation of the device 12 in response to the output signals on lines 57, 59 from the device 12. The computer 22 also generates signals on lines 15, 17, 19 to control the track 16, the printer 18, and the imager 20, respectively.

Figure 2:
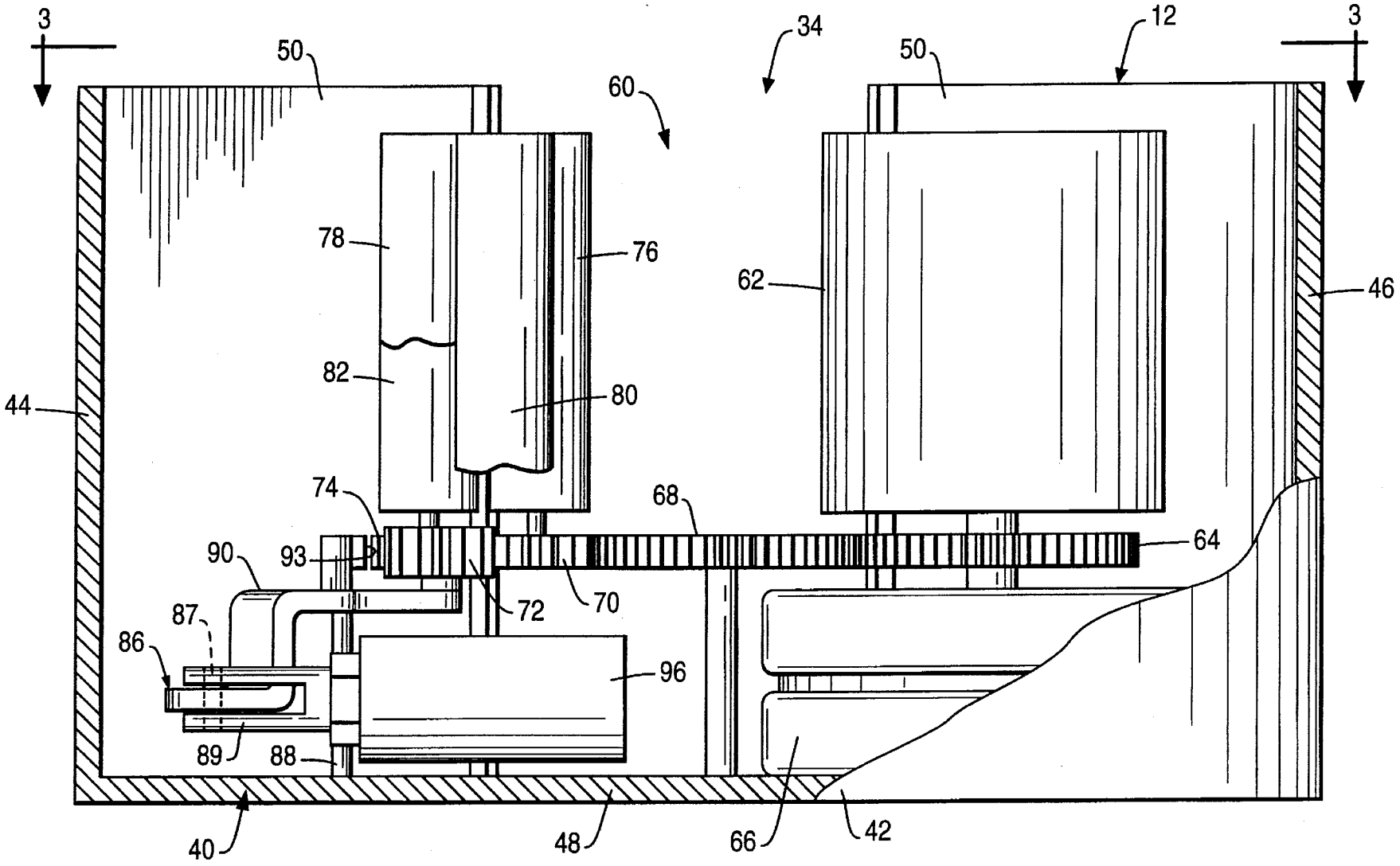
FIG. 2 is an enlarged sectional view taken approximately along line 2—2 in FIG. 1.
Figure 3:
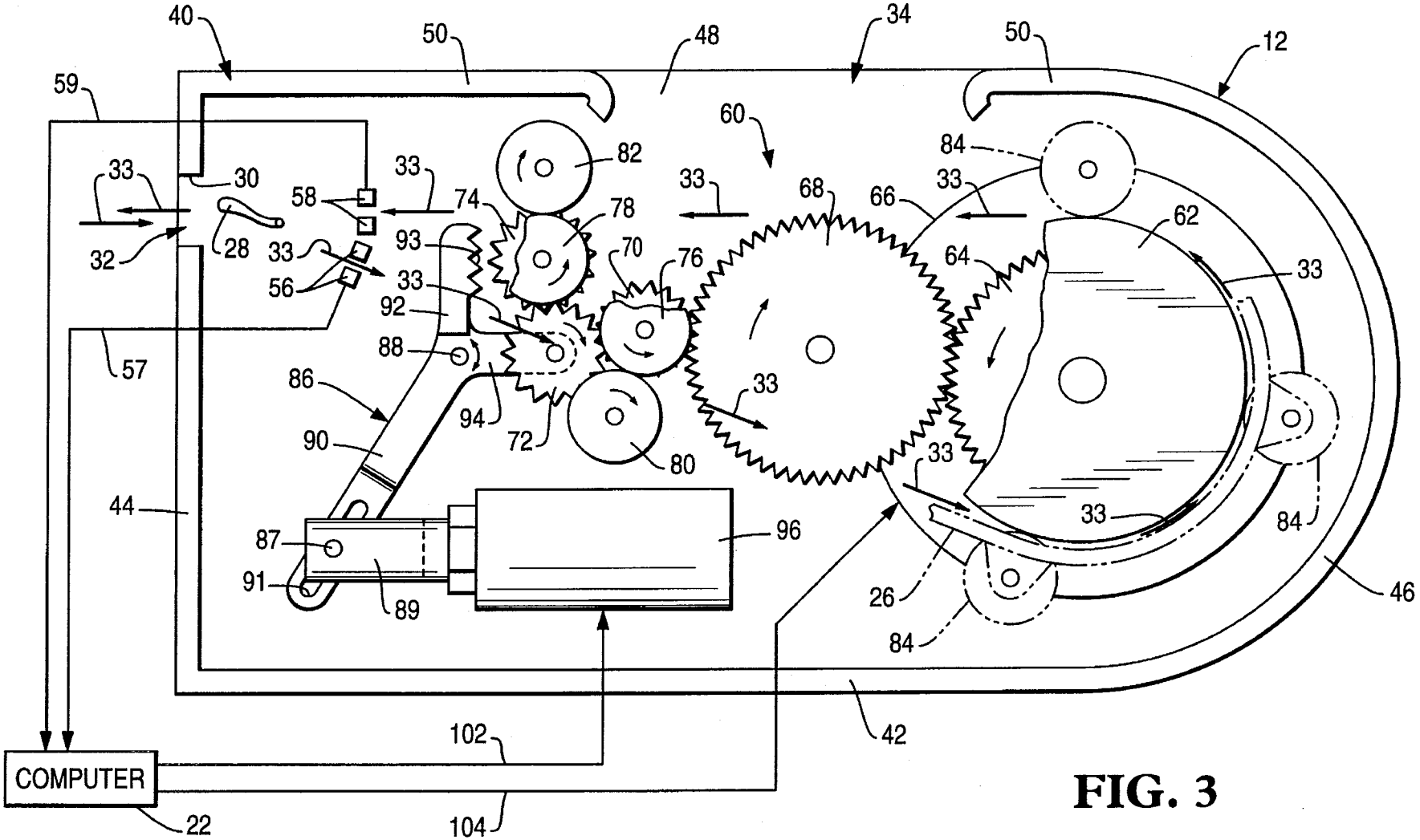
FIG. 3 is a sectional view taken approximately along line 3—3 in FIG. 2.

Referring to FIGS. 2 and 3, the document handling device 12 comprises a housing unit 40. The housing unit 40 includes a flat bottom wall 42 interconnecting a flat front wall 44 and a curved back wall 46. The front wall 44 has a rectangular opening 32 (FIG. 3) through which a document can pass. The front wall 44 includes a reference surface 30 which defines part of the opening 32. A pair of parallel side walls 48 (only of which one is illustrated in the drawings) interconnects the front and back walls 44, 46 and is connected to the bottom wall 42. A generally flat top wall 50 interconnects the front and back walls 44, 46 and interconnects the side walls 48. The top wall 50 has a generally rectangular opening 34 through which a portion of a document can bulge, as will be described later.

A diverter flap 28 (FIG. 3 ) is also secured to the side walls 48 in a known manner. The diverter flap 28 is biased upwardly, as shown in FIG. 3, towards the reference surface 30 such that an incoming document moving through the opening 32 would be deflected downwardly into a document path 33 (shown as arrows in FIG. 3 ) defined within the housing unit 40. Thus, the diverter flap 28 acts as a guide for a document which is received from the document path of the track 16 through the opening 32 into the device 12.

A transport unit 60 is disposed within the housing unit 40 for receiving a document which is received from the document path of the track 16 through the opening 32. The transport unit 60 includes a formed plate 26 (FIG. 3) which defines at least in part the document path 33 within the housing unit 40. Only a broken away portion of the plate 26 is illustrated in FIG. 3 so that the structure and operation of the system 10 can be more easily described. The plate 26 is secured in a conventional manner to the side walls 48 of the housing unit 40. The plate 26 may also be secured to the other walls of the housing unit 40. The use of a formed plate to define a document path within the housing unit 40 is known. Therefore, the structure of the plate 26 and the method of making the plate 26 are not described.

The transport unit 60 includes a number of rollers and a number of gears operatively connected with the rollers such that the rollers can move a document along the document path 33 within housing unit 40 in a manner in accordance with the present invention. One end of a driving roller 62 is operatively connected with a driving gear 64 which is drivingly connected to the shaft of a DC motor 66. The gear teeth of the driving gear 64 is meshingly engaged with the gear teeth of a motor engaging gear 68 which, in turn, is meshingly engaged with a first driven gear 70. The gear teeth of the first driven gear 70 is meshingly engaged with the gear teeth of a coupling gear 72 which, in turn, is meshingly engaged with gear teeth of a second driven gear 74. The first driven gear 70 is operatively connected with a first driven roller 76, and the second driven gear 74 is operatively connected with a second driven roller 78.

A first idler roller 80 has an outer circumferential surface which faces toward and is biased in a known way against the outer circumferential surface of the first driven roller 76. Similarly, a second idler roller 82 has an outer circumferential surface which faces and is biased in a known way against the outer circumferential surface of the second driven roller 78. The first and second idler rollers 80, 82 are supported in a known way by the different walls of the housing unit 40. The first and second idler rollers 80, 82 are biased against their respective rollers in a conventional manner, like the use of springs, for example. Accordingly, the mounting of the first and second idler rollers 80, 82 and the biasing action thereof against their respective rollers will not be described.

A number of idler rollers 84 extend through openings spaced apart along a generally semicircular portion of the plate 26, as shown in FIG. 3. Each of the idler rollers 84 has an outer circumferential surface which engages the outer circumferential surface of the driving roller 62. The idler rollers 84 are also supported by the different walls of the housing unit 40 and are biased against the driving roller 62 in a known manner. Accordingly, the mounting of the idler rollers 84 and the biasing thereof against the driving roller 62 will not be described.

A braking part 86 is mounted on one side of the housing unit 40 for pivotal movement about a pivot shaft 88 which is secured to the side walls 48 of the housing unit 40. The braking pan 86 includes a stem portion 90 and first and second arm portions 92, 94 extending away from the pivot shaft 88 as shown in FIG. 3. The free end of the first arm portion 92 includes a face 93 having teeth which is meshingly engageable with the gear teeth of the second driven gear 74. The center axis of the coupling gear 72 is rotatably mounted on the free end of the second arm portion 94. The stem portion 90 has an elongated slot 91.

An actuatable solenoid 96 is mounted on the same side of the housing unit 40 as the braking part 86. The solenoid 96 includes an armature 89 having a clevis pin 87 which extends through the elongated slot 91 of the stem portion 90 of the braking part 86. The clevis pin 87 prevents the armature 89 and the stem portion 90 of the braking part 86 from disengaging. When the solenoid 96 deactuated, as shown in FIG. 3, the teeth on the face 93 of the first arm portion 92 of the braking part 86 does not engage the gear teeth of the second driven gear 74.

A first sensor unit 56 is located in the vicinity of the diverter flap 28 as shown in FIG. 3. The first sensor unit 56 may include a photodiode/photosensor pair which cooperates to detect the presence of a document between the photodiode and the photosensor. When the first sensor unit 56 detects the presence of a document, the first sensor unit 56 provides a signal on line 57 indicative thereof. A second sensor unit 58 is located between the diverter flap 28 and the second driven roller 78, as shown in FIG. 3. The second sensor unit 58 may also include a photodiode/photosensor pair which cooperates to detect the presence of a document between the photodiode and the photosensor. When the second sensor unit 58 detects the presence of a document, the second sensor unit 58 provides a signal on line 59 indicative thereof. Such sensors are well known and, therefore, will not be described.

The computer 22 monitors the signal on line 57 from the first sensor unit 56 and the signal on line 59 from the second sensor unit 58. In response to the signals on lines 57, 59 from the first and second sensor units 56, 58, the computer 22 generates signals on lines 102, 104 to control operation of the motor 66 and the solenoid 96, respectively, in manner to be described hereinbelow.

Figure 4:
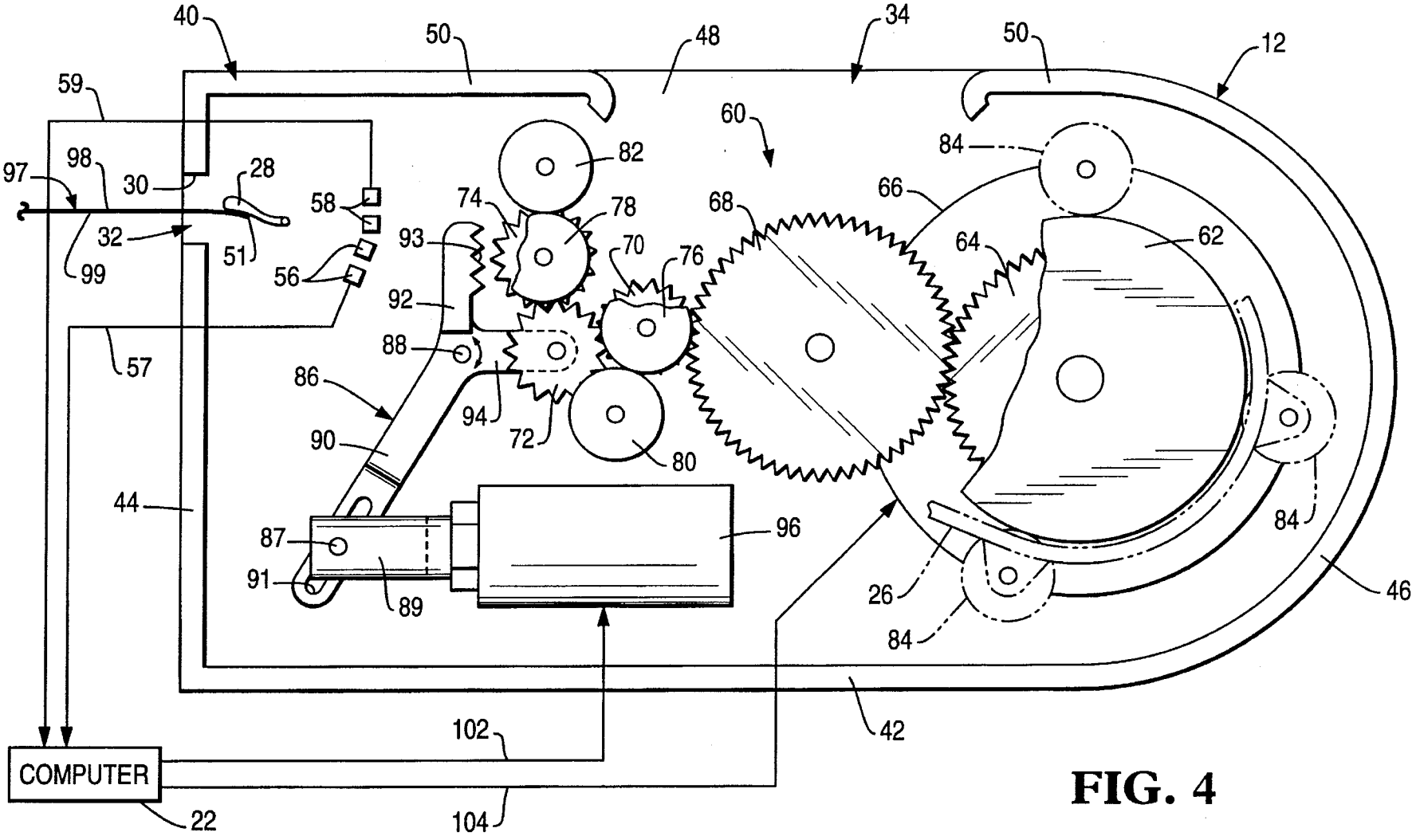
FIG. 4 is a view similar to FIG. 3 and showing a double-sided document being processed by the document handling device.

Referring to FIG. 4, a document 97 to be processed by the device 12 is lifted in a conventional manner from the sheet feeder 11 on the transport mechanism (not shown) of the track 16. The document 97 has a leading edge 51 which is initially fed through the opening 32 as the document 97 is moved by the transport mechanism of the track 16 along the document path of the track 16 towards the device 12. The document 97 has a first major side surface 98 which faces toward the reference surface 30 of the housing unit 40 and a second major side surface 99 which faces away from the reference surface 30 as the document 97 moves through the opening 32. At this time, the motor 66 is deenergized and the solenoid 96 is deactuated.

Figure 5:
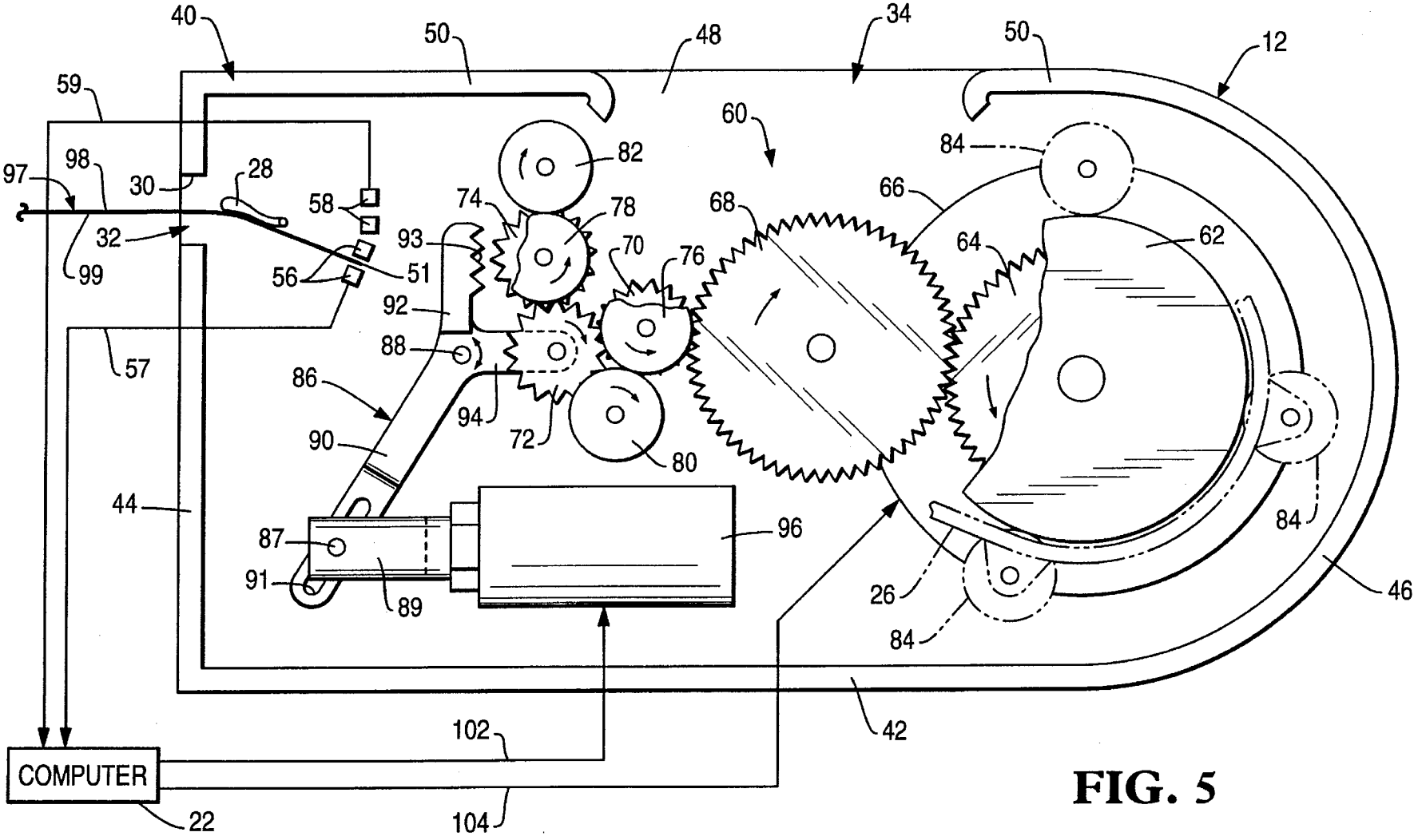
FIGS. 5–11 are views similar to FIG. 4 and showing the double-sided document in different positions.

As the document 97 continues to move through the opening 32, the leading edge 51 engages a surface of the diverter flap 28 which guides the leading edge 51 into the document path 33 within the housing unit 40. The leading edge 51 is guided into the path 33 such that it passes between the photodiode and the photosensor of the first sensor unit 56, as shown in FIG. 5. When this occurs, the first sensor unit 56 provides a signal on line 57 indicative thereof. In response to the signal on line 57, the computer 22 provides a signal on line 102 to energize the motor 66.

When the motor 66 is energized, the driving gear 64 rotates in the counter-clockwise direction as indicated with an arrow in FIG. 5. This rotation results in the motor engaging gear 68 rotating in the clockwise direction, the first driven gear 70 rotating in the counter-clockwise direction, the coupling gear 72 rotating in the clockwise direction, and the second driven gear 74 rotating in the counter-clockwise direction.

Figure 6:
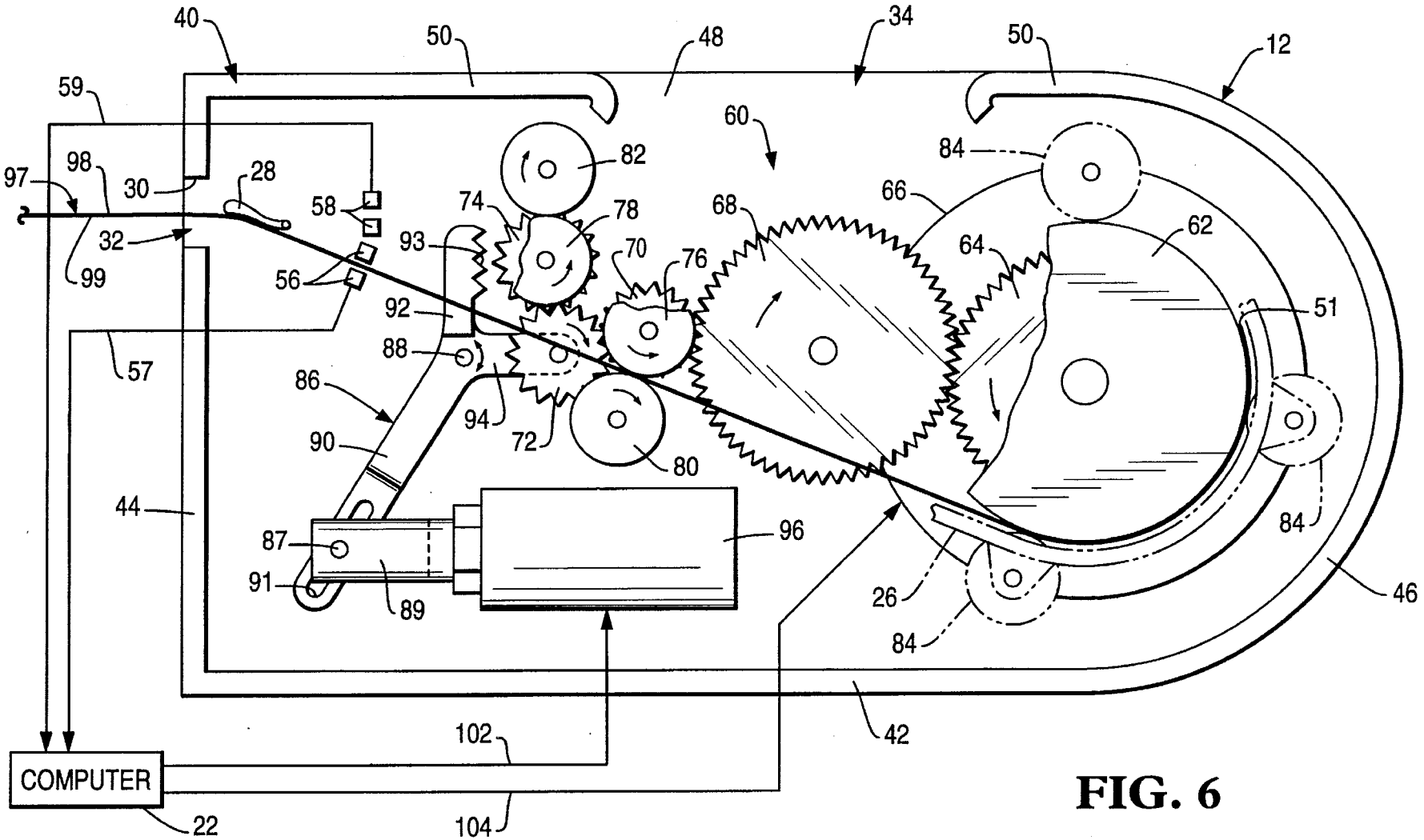

As the document 97 continues to move along the document path of the track 16 towards the device 12, the leading edge 51 of the document 97 moves into the nip defined between the first driven roller 76 and the first idler roller 80. The cooperation of the first driven roller 76 and the first idler roller 80 moves the document 97 along the document path 33 within the housing unit 40. The leading edge 51 continues moving along the document path 33 which passes through the nips defined between the driving roller 62 and the idler rollers 84 as shown in FIG. 6. The leading edge 51 then moves through the nip defined between the second driven roller 78 and the second idler roller 82.

Figure 7:
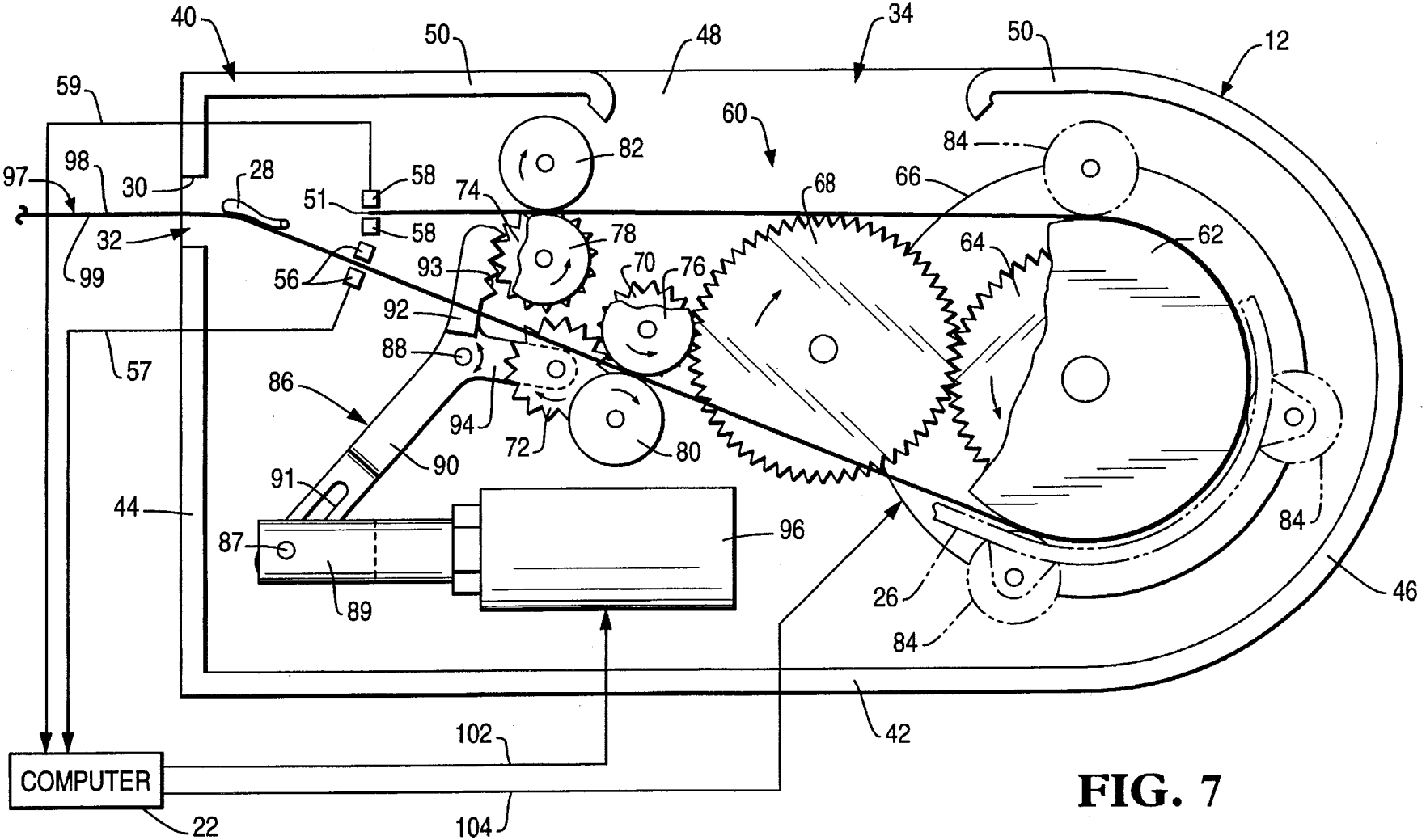

The leading edge 51 continues moving along the document path 33 within the housing unit 40 until it passes between the photodiode and the photosensor of the second sensor unit 58 and provides a signal on line 59 indicative thereof, as shown in FIG. 7. When this occurs, the computer 22 generates a signal on line 104 to actuate the solenoid 96. When the solenoid 96 is actuated, the braking part 86 pivots clockwise about the pivot shaft 88, as shown in FIG. 7.

When the braking part 86 pivots clockwise about the pivot shaft 88, the teeth on the face 93 of the first arm portion of the braking part 86 moves into engagement with the gear teeth of the second driven gear 74 to prevent rotation of the second driven gear 74 about its central axis and, therefore, the second driven roller 78 about it central axis. At the same time, the gear teeth of the coupling gear 72 disengages from the gear teeth of the second driven gear 74. Accordingly, the leading portion of the document 97 is unable to continue its movement through the nip between the second driven roller 78 and the second idler roller 82 because of the teeth of the coupling gear 72 being disengaged from the teeth of the second driven 74.

Figure 8:
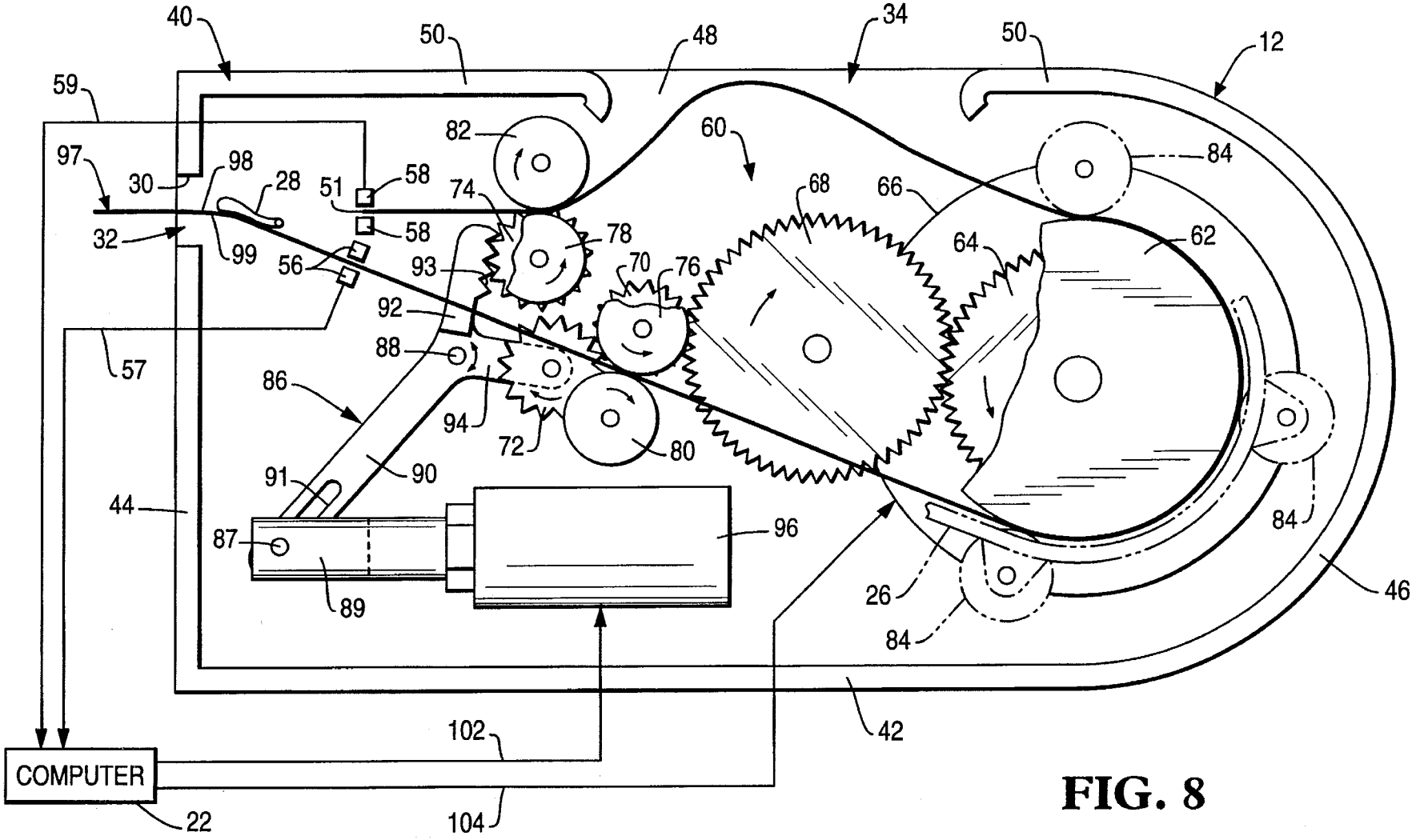

Although the leading portion of the document 97 cannot continue moving through the nip between the second driven roller 74 and the idler roller 82, the first driven roller 76 and the first idler roller 80 continue to cooperate to move the trailing portion of the document 97 along the document path 33 within the housing unit 40. While this is occurring, the central portion of the document 97 located between the leading and trailing portions of the document 97 begins to bulge into an accumulating space within the housing unit 40 and towards the opening 34 in the top wall 50 of the housing unit 40, as shown in FIG. 8, to form a bell-shaped configuration.

Figure 9:
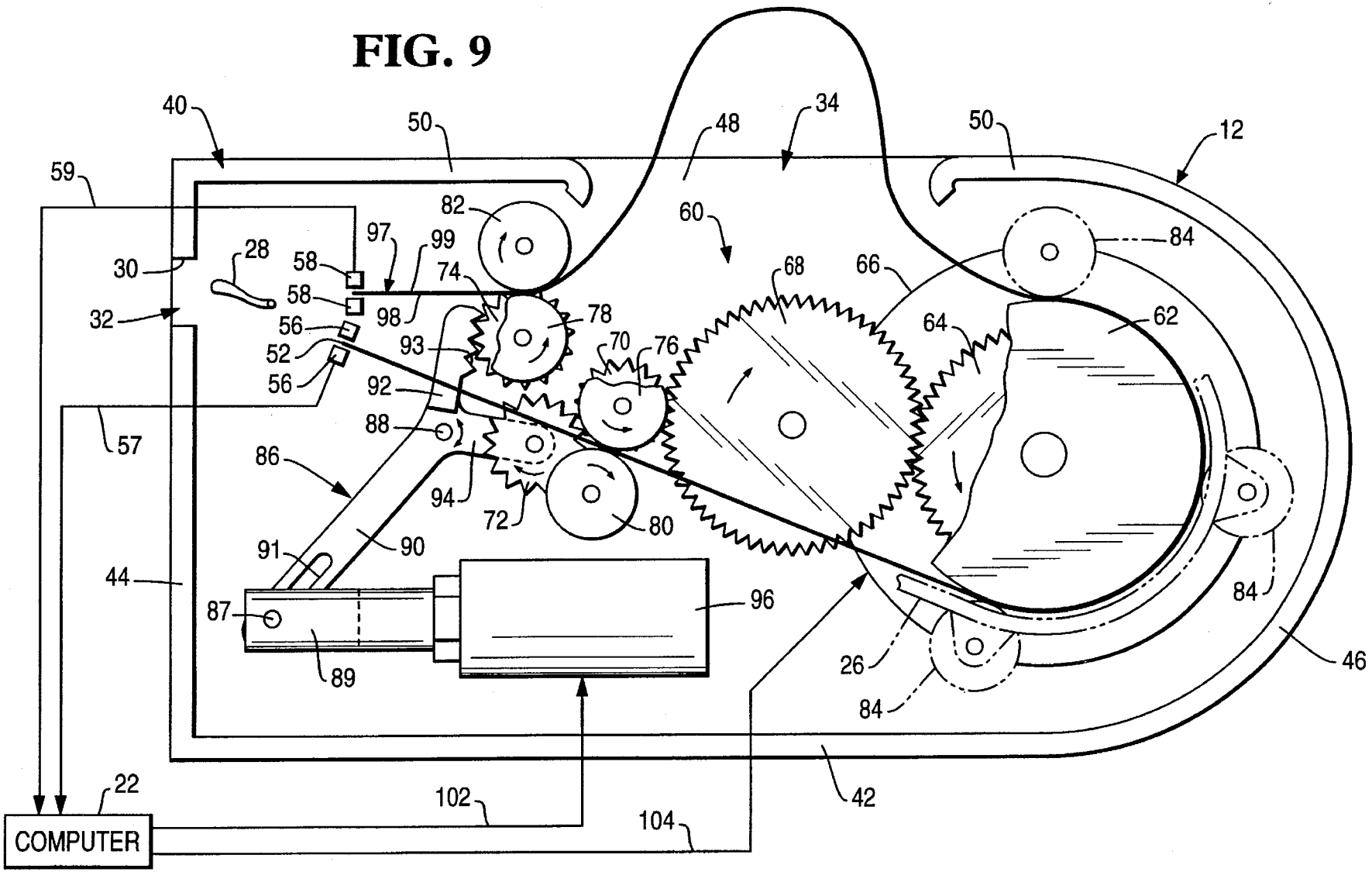

The document 97 bulges into the opening 34 and continues to bulge through the opening 34 until the trailing edge 52 of the document 97 passes between the photodiode and the photosensor of the first sensor unit 56, as shown in FIG. 9. When this occurs, the first sensor unit 56 provides a signal on line 57 indicative thereof. In response to the signal on line 57 from the first sensor unit 56, the computer 22 provides a signal on line 104 to deactuate the solenoid 96. When the solenoid 96 is deactuated, the braking part 86 pivots counter-clockwise about the pivot shaft 88 to disengage the teeth on face 93 from the gear teeth on the second driving gear 74. At the same time, the gear teeth of the coupling gear 72 moves back into engagement with the gear teeth of the second driving gear 74. The reengagement of the gear teeth results in rotation of the second driven roller 78 in the counter-clockwise direction and thereby continued movement of the document 97 through the nip between the second driven roller 74 and the second idler roller 82.

Figure 10:
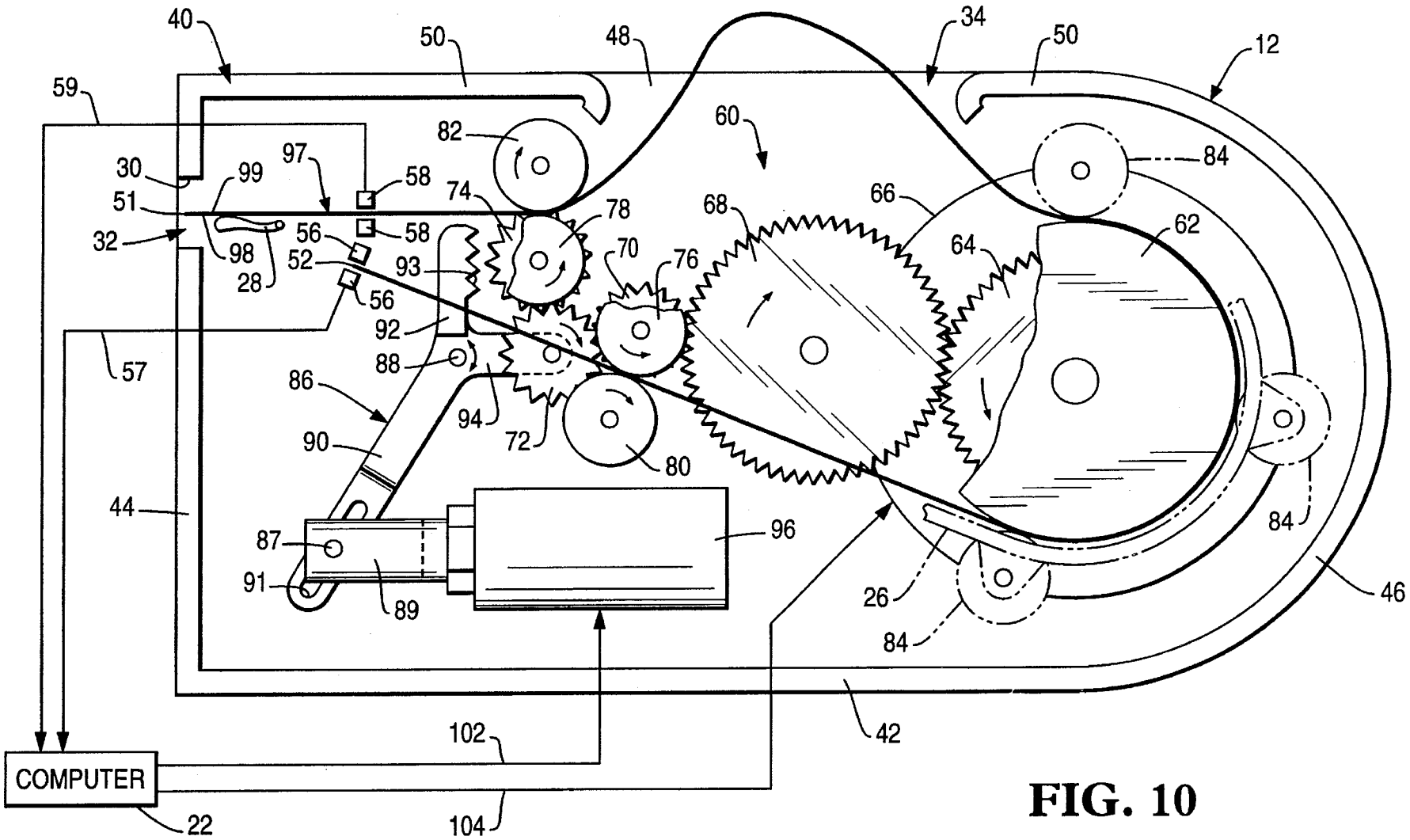

As the document 97 continues to move through the nip between the second driven roller 74 and the second idler roller 82, the shape of the bulge formed by the central portion of the document 97 shown in FIG. 9 begins to flatten. The leading edge 51 of the document 97 moves against the diverter flap 28 and pushes it downwardly and out of the way, as shown in FIG. 10. Eventually, the leading edge 51 moves through the opening 32 back into the document path of the track 16. As the leading edge 51 moves through the opening 32 back into the document path of the track 16, the second major side surface 99 of the document 97 faces toward the reference surface 30 of the housing unit 40 and the first major side surface 98 of the document 97 faces away from the reference surface 30, as shown in FIG. 10. Thus, the document 97 has been overturned.

Figure 11:
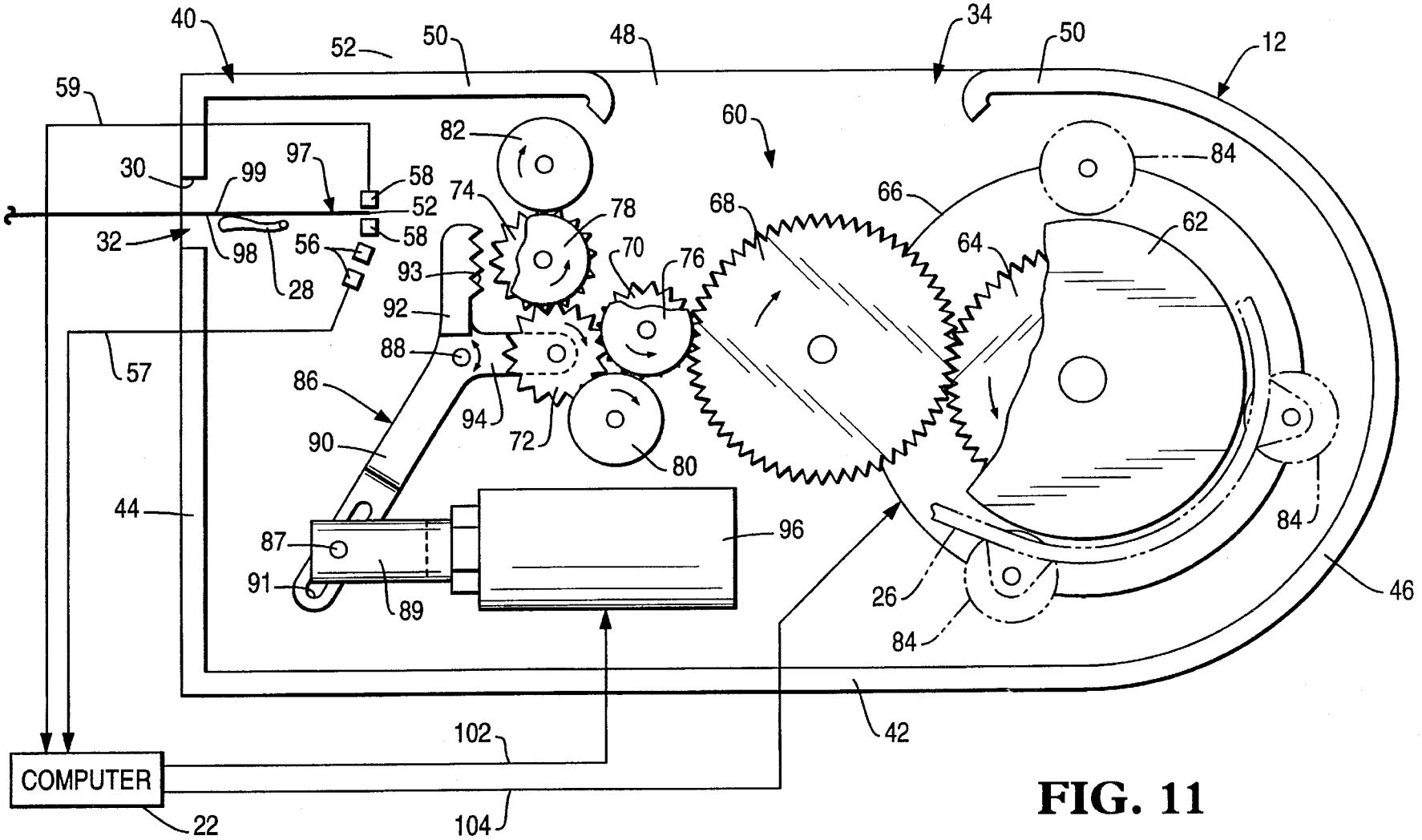

When the leading edge 51 is received in the document path of the track 16, the transport mechanism of the track 16 is actuated by the signal on line 15 from the computer 22 to move the leading edge 51 along the document path of the track 16 in a direction which leads away from the device 12. The earlier formed bulge continues to flatten as the leading edge 51 continues to move away from the device 12. The document 97 continues to move along the document path 33 within the housing unit 40 until the trailing edge 52 passes between the photodiode and the photosensor of the second sensor unit 58, as shown in FIG. 11. When this occurs, the second sensor unit 58 provides a signal on line 59 indicative thereof. In response to the signal on line 59, the computer 22 provides a signal on line 102 to deenergize the motor 66. The document 97 continues to move though the opening 32 by the transport mechanism associated with the track 16. The transport mechanism of the track 16 moves the document 97, which is now overturned, towards the printer 18 and imager 20 (FIG. 1 ) for further processing by these devices. Thereafter, the document 97 is diverted in a conventional manner into the collection bin 13.

A number of advantages result by providing the document handling device 12 in accordance with the present invention. One advantage is that the device 12 is capable of handling a doubled-sided document independent of its lengthwise dimension, i.e., its dimension along the direction of feeding of the document. The device 12 is capable of handling documents having a variety of lengths and is not limited by a particular length of the document. Another advantage is that the device 12 is able to occupy a relatively small "footprint" while having the capability to accommodate double-sided documents having a relatively long lengthwise dimension. Still another advantage is that the use of the device 12 reduces overall cost in a document processing system since front-side and back-side imaging devices, for example, are not required. When the document handling device 12 of the present invention is used, only one such imaging device is needed since the double-sided document is overturned by the device 12. The imaging device captures an image of one side of the double-sided document and after the document is overturned by the device 12 captures an image of the other side of the document.

From the above description of the invention, those skilled in the art will perceive improvements, changes and modifications. Such improvements, changes and modifications within the skill of the art to which the present invention relates are intended to be covered by the appended claim.

What is claimed is:

1. A document handling device for overturning a document having a first side, a second side lying opposite the first side, a leading edge, a trailing edge, and a relatively long lengthwise dimension between the leading and trailing edges without reversing the leading and trailing edges, said device comprising:

a housing unit including an outer wall and a reference surface defining at least in part a document feed opening in said wall through which the document is fed into a document path defined within said housing unit; and a transport unit for (i) receiving the document which has been fed through the document feed opening with the first side of the document facing said reference surface of said housing unit, (ii) overturning the received document, (iii) feeding the overturned document back through the same document feed opening with the second side of the document facing said reference surface of said housing unit and (iv) generating a bulge in the document while the document is being overturned;

said housing units defining an accumulating space into which the document can bulge while the document is being overturned.

2. A document handling device according to claim 1 further comprising a sensor unit located adjacent the document feed opening of said housing unit for detecting the presence of the leading and trailing edges of the document.

3. A document handling device according to claim 2 wherein said transport unit includes a mechanism which (i) engages the document to feed the document along the document path alter said sensor unit has detected the presence of the leading edge of the document and (ii) engages a leading portion of the document to inhibit the leading edge of the document from further movement along the document path until said sensor unit detects the presence of the trailing edge of the document.

4. A document handling device according to claim 3 further comprising a control unit responsive to said sensor unit for controlling operation of said mechanism.

* * * * *

UNITED STATES PATENT AND TRADEMARK OFFICE

CERTIFICATE OF CORRECTION

PATENT NO. : 5,597,157

DATED : January 28, 1997

INVENTOR(S) : Alistair R. Hamilton et al.

It is certified that error appears in the above-identified patent and that said Letters Patent is hereby corrected as shown below:

Column 8, line 21, "alter" should be --after--.

Signed and Sealed this

Twenty-seventh Day of May, 1997

*Attest:*

Bruce Lehman

BRUCE LEHMAN

*Attesting Officer*

*Commissioner of Patents and Trademarks*